US006527081B1

(12) United States Patent
Tyner et al.

(10) Patent No.: US 6,527,081 B1
(45) Date of Patent: Mar. 4, 2003

(54) EMBANKMENT STAIRWAY

(75) Inventors: Sandy W. Tyner, Hartsville, SC (US); Ronald W. Bennett, Florence, SC (US)

(73) Assignee: Aluminum Ladder Company,, Florence, SC (US)

( * ) Notice: Subject to any disclaimer, the term of this patent is extended or adjusted under 35 U.S.C. 154(b) by 0 days.

(21) Appl. No.: 09/870,155

(22) Filed: May 30, 2001

(51) Int. Cl.[7] ..... E06C 9/00
(52) U.S. Cl. ..... 182/1; 52/183
(58) Field of Search ..... 182/1; 52/182–191

(56) References Cited

U.S. PATENT DOCUMENTS 501,694 A * 7/1893 Richards ..... 182/1
1,167,893 A * 1/1916 Fickinger ..... 182/1
2,245,825 A * 6/1941 Ross ..... 108/1
3,299,590 A * 1/1967 Carter
3,470,664 A * 10/1969 Whitehead ..... 52/183
4,421,206 A * 12/1983 Kummerlin
4,959,935 A * 10/1990 Stob
5,329,871 A * 7/1994 Gibbs ..... 114/363

FOREIGN PATENT DOCUMENTS

SE 117 582 * 11/1946 ..... 182/1

* cited by examiner

*Primary Examiner*—Alvin Chin-Shue
(74) *Attorney, Agent, or Firm*—Charles L. Schwab; Nexsen Pruet Jacobs & Pollard, LLC

(57) ABSTRACT

A portable embankment stairway with steps that can be adjusted for the slope of the section of the embankment on which it is temporarily installed to provide level footing for workmen on the stairway.

4 Claims, 9 Drawing Sheets

EMBANKMENT STAIRWAY

REFERENCE TO EARLIER FILED UNITED STATES PATENT APPLICATION

Priority benefits are claimed based on a copending U.S. patent application, Ser. No. 09/592,817 of Sandy W. Tyner and Ronald W. Bennett, entitled Embankment Stairway, filed Jun. 13, 2000.

TECHNICAL FIELD

The present invention relates to an embankment stairway and particularly to a portable embankment stairway so designed that it can be secured to the ground and its steps fixed in an adjusted position appropriate for the inclination of the part of the embankment on which the stairway is installed.

BACKGROUND OF THE INVENTION

During the construction and repair of throughways, i.e. railways and automotive roads, it is often necessary to build or repair bridges having a lattice work of supporting trestles. These bridges and trestles span valleys, gorges and the like and may rise to considerable heights, depending on the height of the associated embankment. As such, the construction and upkeep of these structures often places workers in precarious and/or treacherous situations as they attempt to scale or remain safely footed upon the various associated embankments. These embankments often have sections of different pitches or inclinations. There exists a great need for a safe temporary stairway for embankments and other inclines, such as are often associated with bridges and trestles, which can be quickly installed with steps adjusted for the slope of the inclination.

An ideal stairway must not only be safe, but also easily portable. For example, as additional supporting trestles are completed during construction, an ideal platform must be moved to facilitate new work, such as for the further expansion of the trestle system. Thus, as construction and/or repair moves to different sites along an embankment, so must the embankment stairway. The embankments involved in railway bridges and trestle construction may be hundreds of feet in length with variations in slope. This creates the need for a considerable number of stairway sections with steps that can be adjusted for the slope on which each section is installed so as to provide level step treads.

OBJECTS AND SUMMARY OF THE INVENTION

It is an object of the present invention to provide a portable embankment stairway that provides level footing over a wide range of stairway angles.

It is another object of the present invention to provide a portable embankment stairway whose steps can be adjusted so that the treads of the steps are coplanar to form a walkway or work platform.

It is another object of the present invention to provide a portable embankment stairway having pivotably adjusted steps permitting a series of such stairways to be advantageously installed on an embankment with an irregular slope.

It is another object of the present invention to provide a portable embankment stairway that is compact for easy storage and transportation.

It is another object of the present invention to provide a portable stairway that is lightweight for easy assembly and movement.

These and other objects are obtainable by providing a portable embankment stairway adapted to be staked to the ground, which includes a frame having a pair of parallel side rails and a plurality of steps pivotally connected to and transversely disposed between the side rails, the steps being adjustable to provide level step treads for a wide range of embankment slopes.

BRIEF DESCRIPTION OF THE FIGURES

The present invention is illustrated in the accompanying drawings, in which.

DETAILED DESCRIPTION OF THE INVENTION

The present invention provides a portable embankment stairway that solves a number of problems associated with the construction and upkeep of bridges, trestles and other structures along natural and artificial embankment surfaces. As such, it can be positioned beside or between trestles or under or adjacent to an associated bridge. When staked to the ground in end-to-end fashion, an embankment stairway of great length can be formed. This invention provides a portable stairway having level tread footing over a wide range of stairway angles such that it can be used as an inclined stairway or as a walkway or other horizontal platform. In addition, the present invention provides a portable stairway that is both compact for easy transportation and storage, and is light in weight for easy portage and installation.

The steps are pivotally adjustable to provide level step treads for slopes up to about 60 degrees. The steps of each stairway section are adjusted to provide level step treads for the segment of the embankment on which the section is staked. The slope can vary from horizontal, or zero degree slope, to a slope angle of about sixty degrees.

Figure 1:
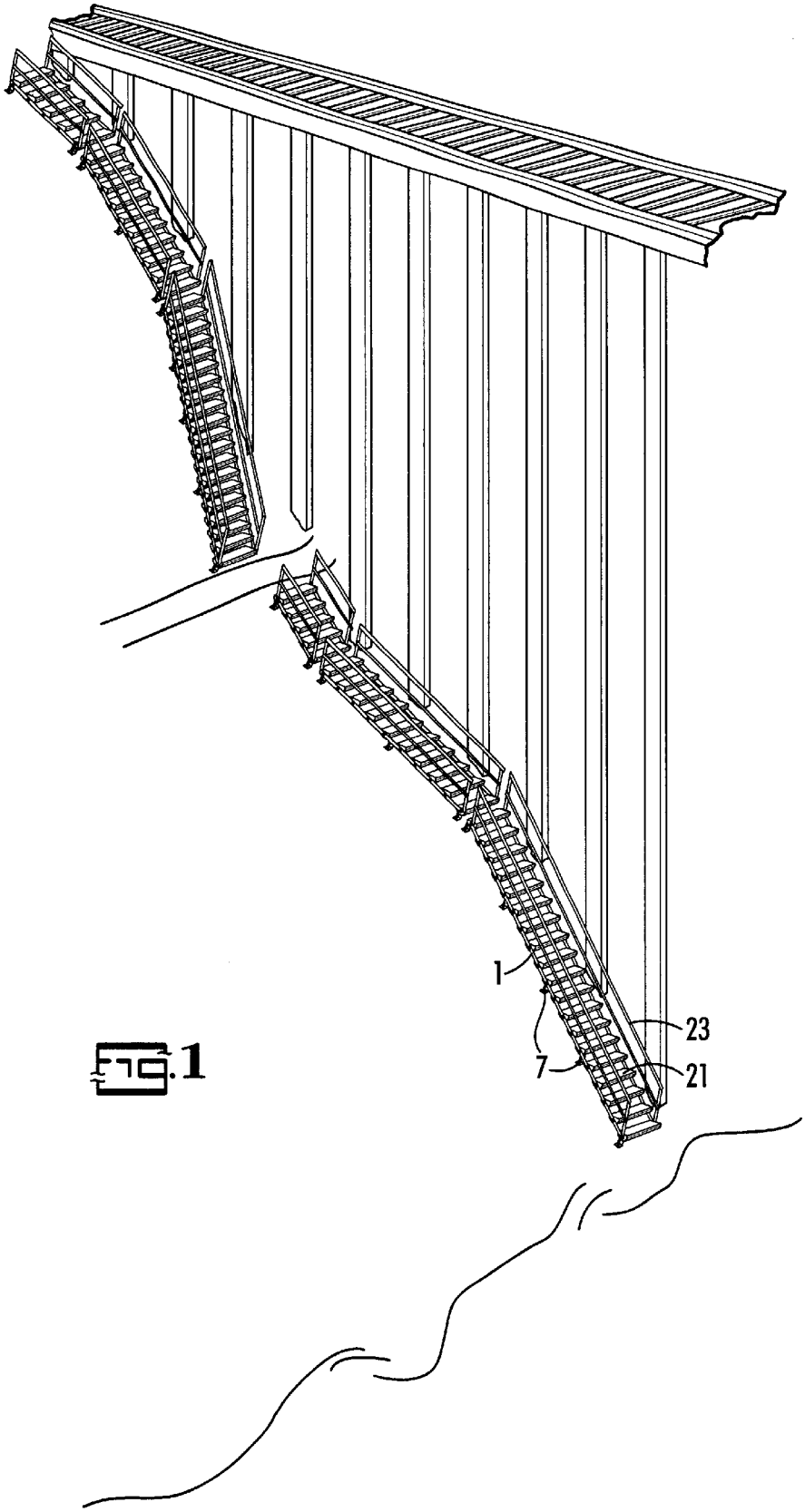
FIG. 1 is a perspective view of several portable embankment stairways staked to an embankment having a bridge trestle.

Referring to FIGS. 1 through 4, the embankment stairway of the present invention includes a frame 1, steps 21 and a handrail assembly 23. As seen in FIG. 1, stairway sections of various lengths are attached to an embankment by steel rods (not shown) of varying lengths according to application, driven into the embankment through holes 10 in outwardly extending tabs of transverse members 7 of the frame 1. Although the embankment slope varies from top to bottom, the steps 21 of each section have been adjusted so that the step treads are level.

Figure 3:
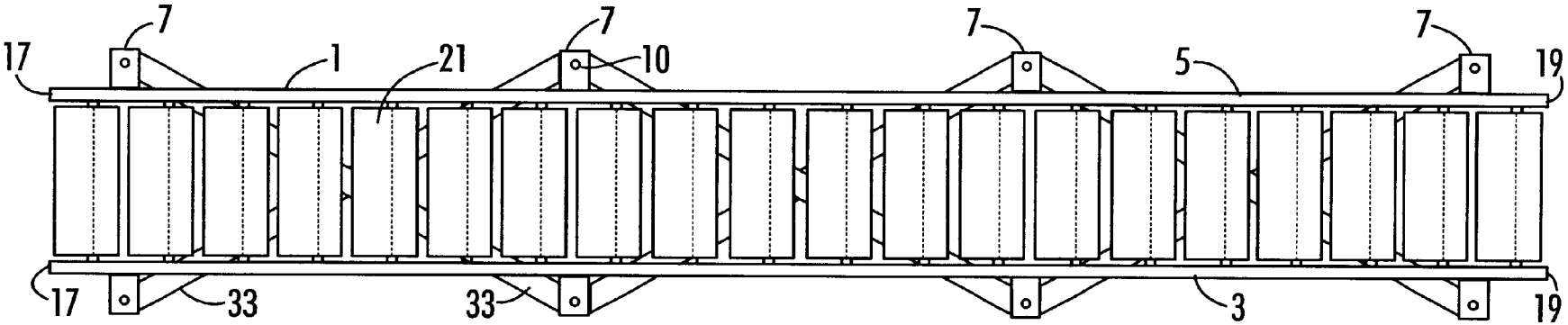
FIG. 3 is a plan view of the portable embankment stairway of FIG. 2 with the hand rail removed and the steps adjusted to provide coplanar treads.
Figure 7:
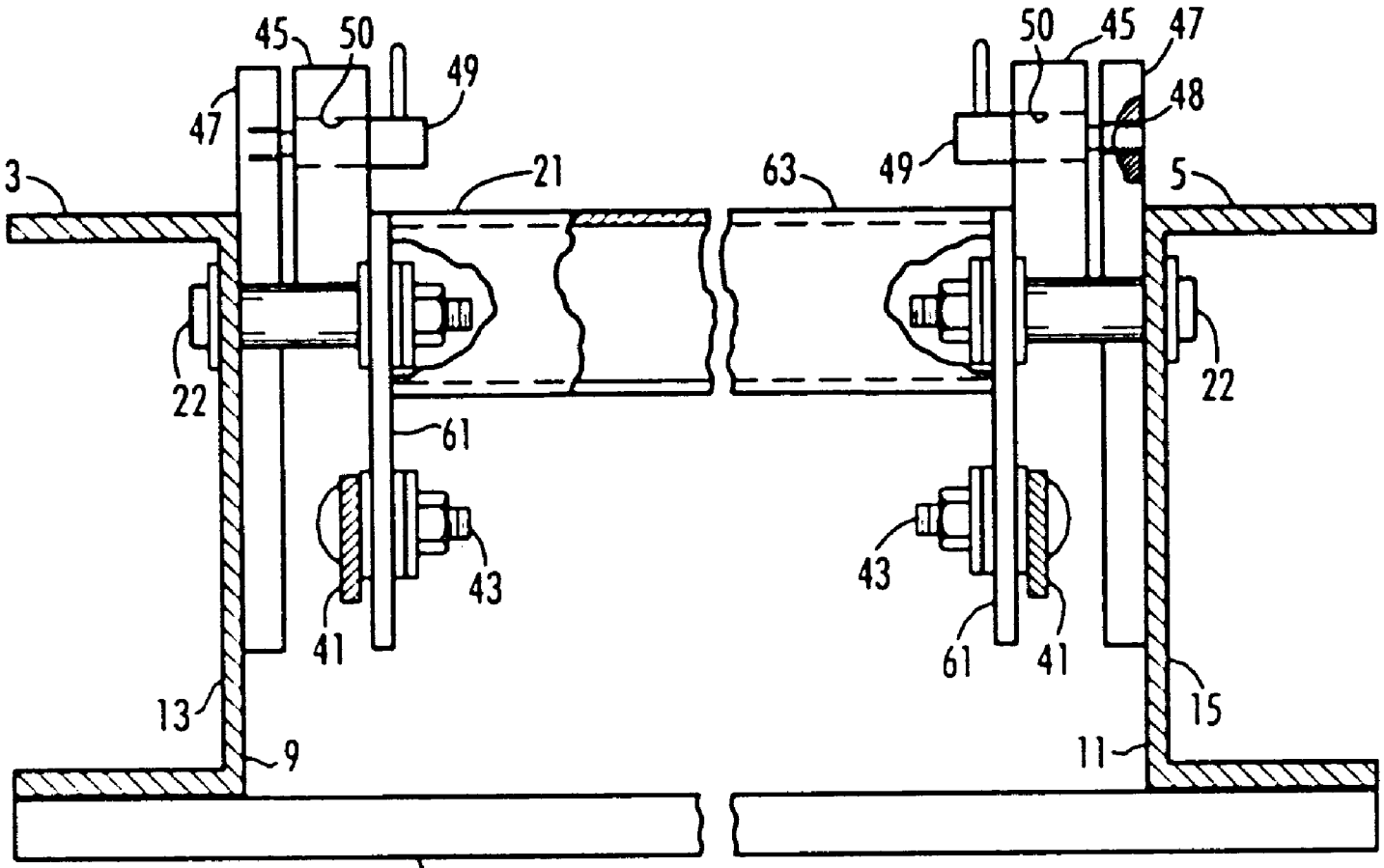
FIG. 7 is a section, with parts broken away, showing the step locking device of FIG. 6 and pivot connection between the step and the side rails and between the step and the tie bar.

As seen in FIG. 3, the frame 1 includes two parallel channel shaped side rails 3 and 5 that are connected to each other by four transverse members or beams 7 welded to the undersides of the side rails 3, 5. Transverse members 7 act as crossbeams which space apart rails 3 and 5. As such, side rails 3 and 5 are mutually connected by, and mutually spaced apart by, the transverse members 7 welded thereto. Referring also to FIG. 7, the side rails 3 and 5 each have respective inner surfaces 9 and 11, respective outer surfaces 13 and 15 and opposite ends 17 and 19. The steps 21 are transversely disposed between and pivotally connected to side rails 3 and 5 by pivots pins 22 are pivotal movement about the parallel transverse axes of the pins 22.

Figure 2:
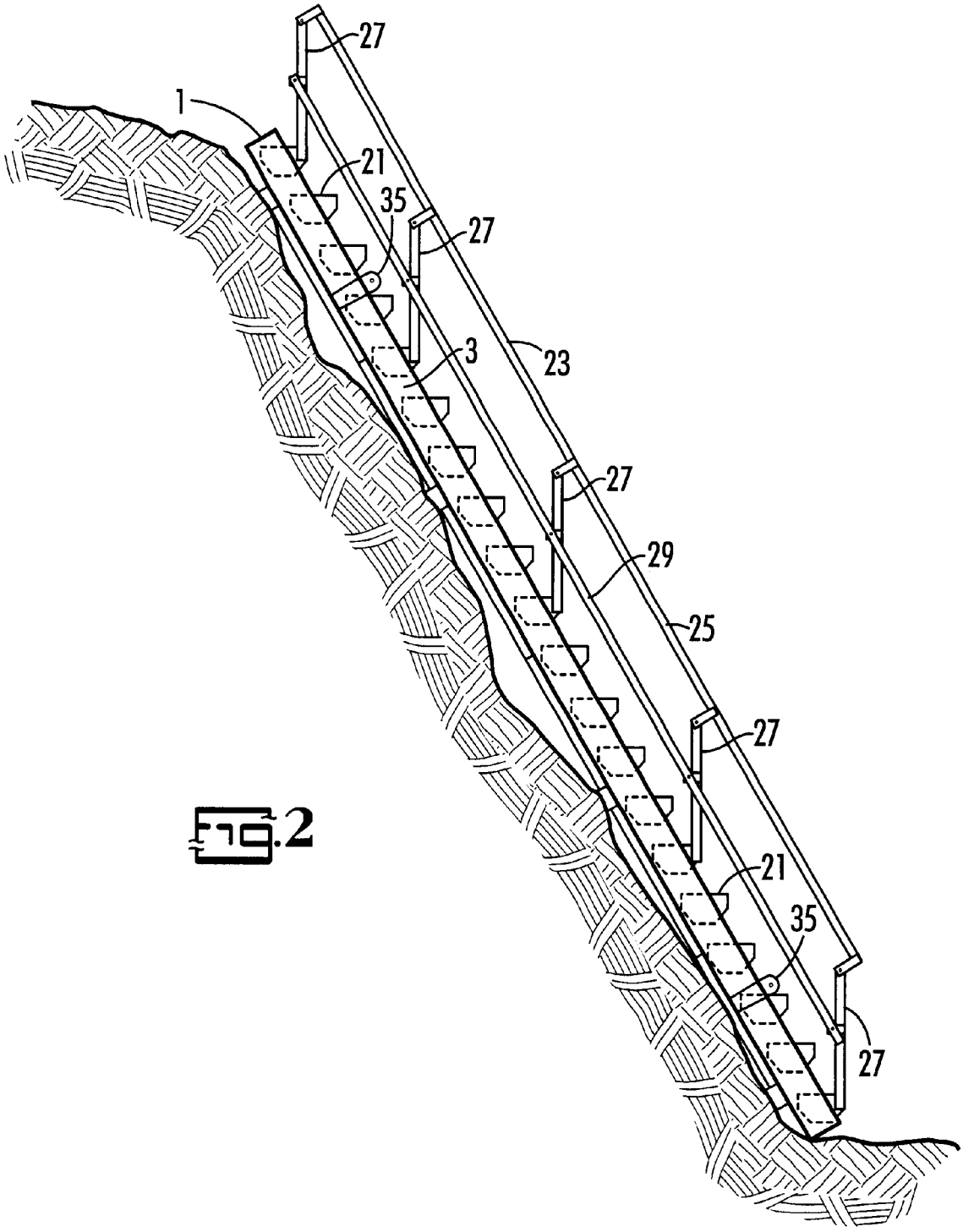
FIG. 2 is a side view of a portable embankment stairway in accordance with the present invention.

As shown in FIG. 2, a handrail assembly 23 is fixedly connected to five of the steps 21. The hand rail assembly 23 includes a handrail 25, a mid-rail 29 and upright connecting members 27 which are welded at their lower ends to associated steps 21. The connecting members 27 are pivotally attached to the hand rail 25 and to the mid-rail 29. Connected as such, the hand rail 25 and the mid-rail 29 remain parallel to and equidistance from each other. They also remain parallel to the side rails 3 and 5.

Figure 4:
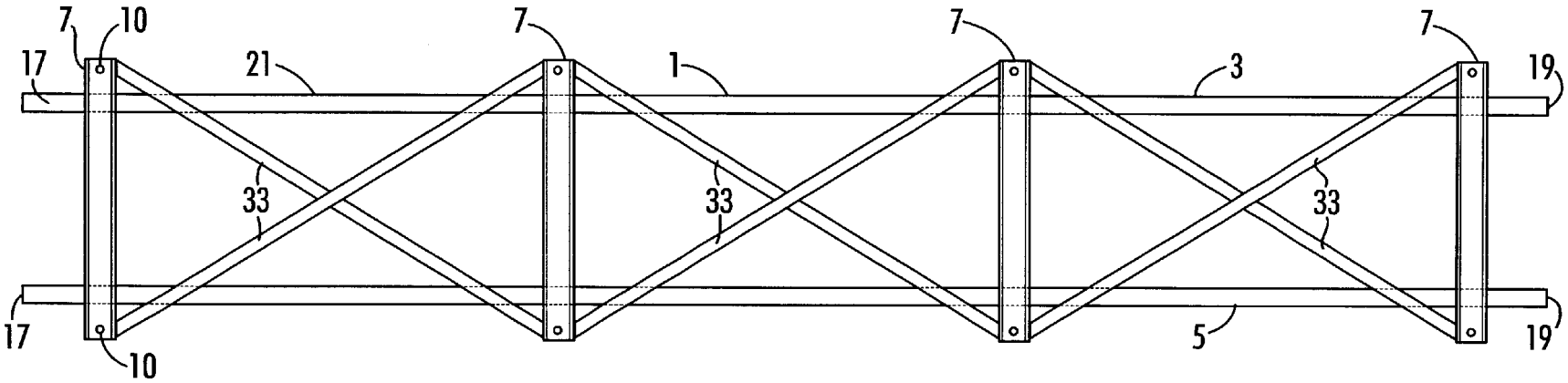
FIG. 4 is a bottom view of the frame of the portable embankment stairway shown in FIG. 3.

FIG. 4 is a bottom view showing the transverse members 7 rigidly connecting the side rails 3 and 5 to each other. These connections, and the structural integrity of frame 1, are reinforced by cross braces 33, which likewise may be welded to the side rails 3 and 5 and to the transverse members 7.

Figure 5:
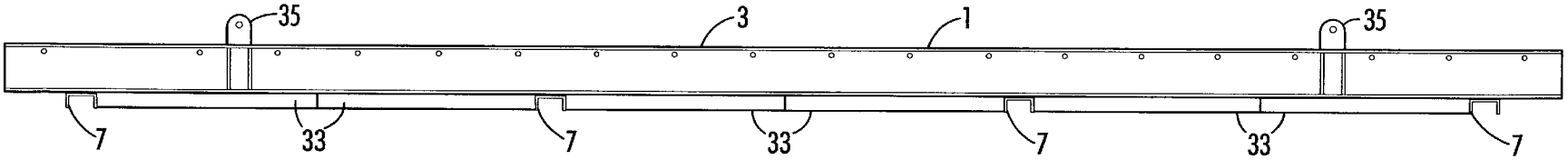
FIG. 5 is a side view of the frame portion of the portable embankment stairway of FIG. 3.

As seen in FIG. 5, two lifting lugs 35 are welded to each of the side rails 3 and 5 to receive ropes, cables, hooks or other means for installing and removing the embankment stairway. The structural components of the embankment stairway are preferably made of a light weight material such as aluminum to enhance the portability of the stairway.

Figure 6:
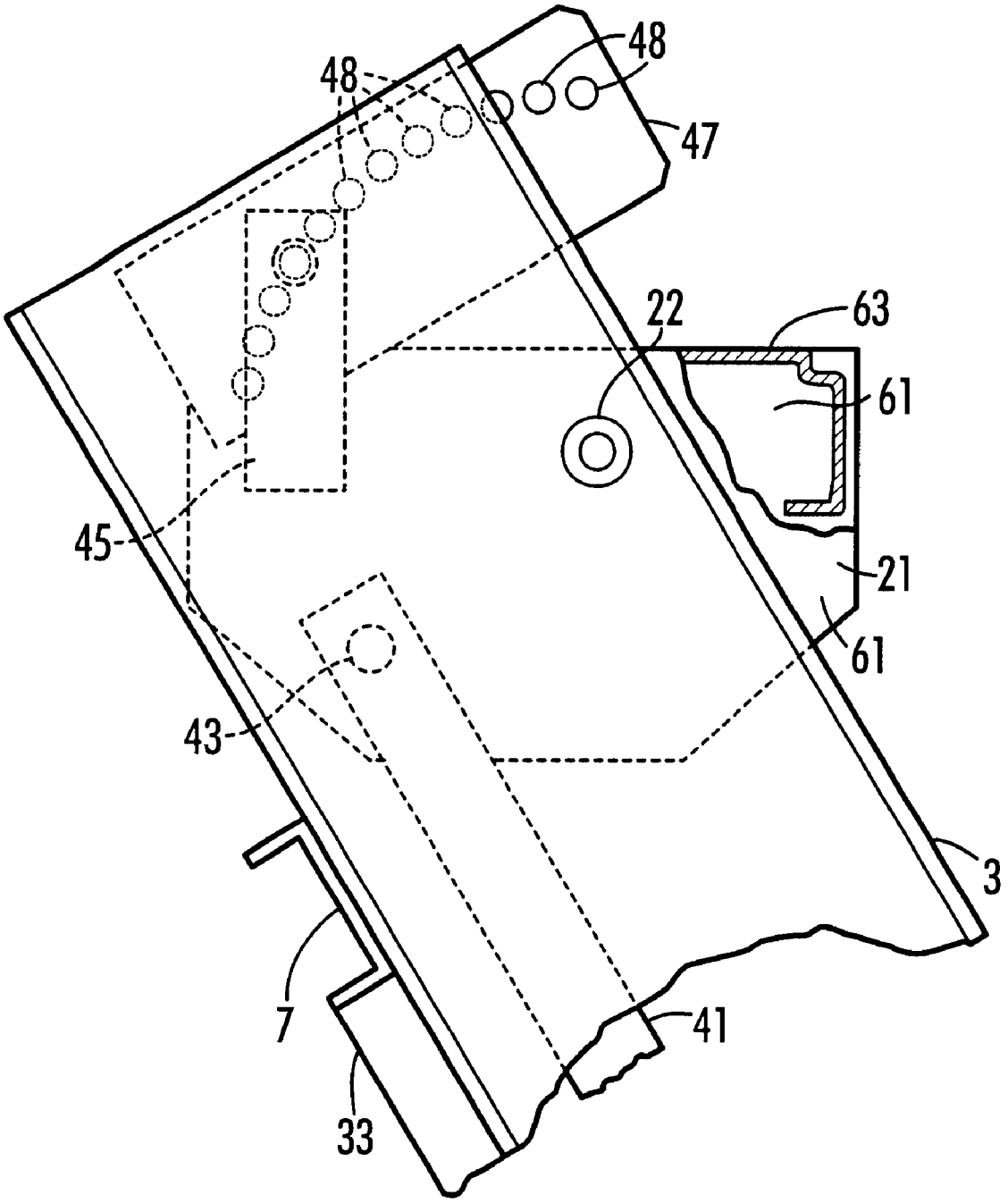
FIG. 6 is a side view of a releasable step locking device of the portable embankment stairway of FIG. 2.
Figure 9:
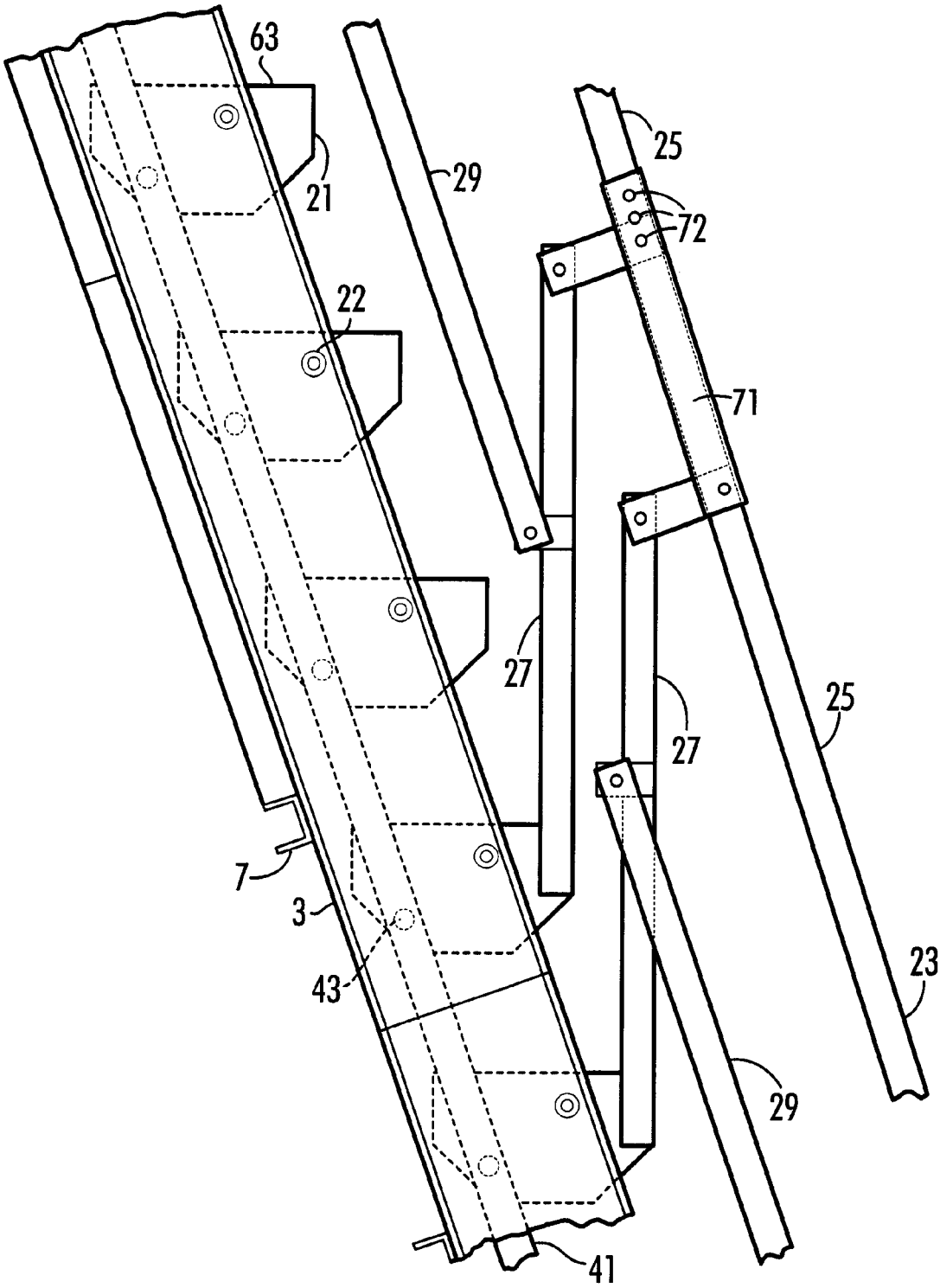

As before mentioned, the steps 21 lie between and are pivotally connected to the rails 3 and 5. Disposed in this manner, each of the steps 21 provides a level, horizontal surface or tread 63 upon which a worker can stand. As seen in FIGS. 6, 7 and 9, a tie bar 41 is pivotally connected to each step 21 by a pivot pin 43 and when one step 21 is rotated, all the steps are rotated in unison. The steps 21 accordingly can be pivoted in unison to place each step in a horizontal tread position when the stairway is staked to an embankment. This allows the ladder to provide a safe worker platform for a wide range of embankments, slopes and inclined surfaces.

In particular, and as seen in FIGS. 6 and 7, each step 21 includes two side plates 61 welded to the laterally opposite ends of the tread 63.

As seen in FIGS. 6 and 7, a pair of releasable step locking mechanisms are provided to lock an end step 21 to the side rails 3 and 5 at any one of various pivot positions. The locking mechanism includes a plurality of openings 48 in plates 47 welded to the side rails 3, 5, the openings 48 being circumferentially spaced from one another about an arc whose center is coaxial with the transverse axis about which the end step 21 pivots relative to the side rails 3 and 5. A pair of stainless steel tabs 45 are welded to the end plates 61 of the end step 21 and include threaded openings 50 for receiving a threaded spring loaded locking pin 49. This allows a user to releasably lock the steps 21 in an angled position in relation to the elongated direction of the side rails 3, 5 to match the slope of the embankment on which the stairway is being staked.

Figure 8:
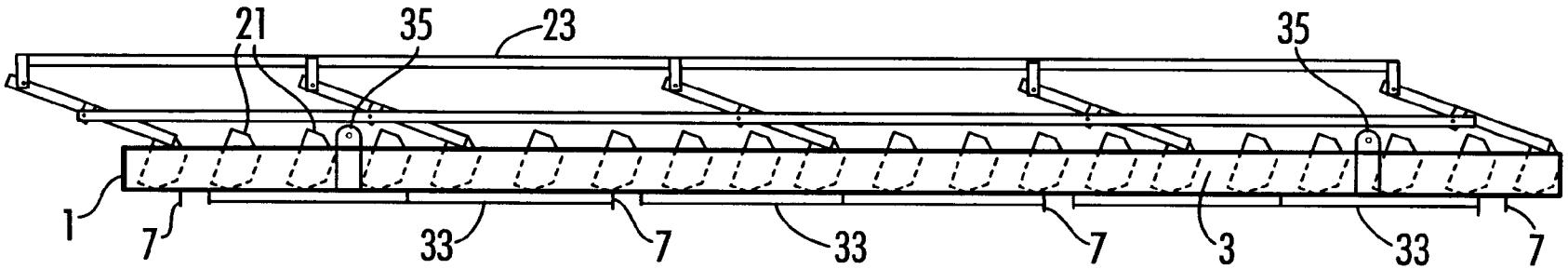
FIG. 8 is a side view of the portable embankment stairway of FIG. 2 in a collapsed position and FIG. 9 is a side view showing an interconnection between hand rails of two embankment stairways placed end-to-end.

As seen in FIG. 8, the handrail assembly 23 is folded towards frame 1 for compact storage of the embankment stairway. In this collapsed position stairways may be easily stacked for transportation or storage.

Embankment stairways of various lengths are preferably used on embankments having irregular slopes. If desired, embankment stairways may be placed end to end, as shown in FIG. 9, and their hand rail assemblies interconnected end to end by a connector bar 71. The connector bar 71 has a series of holes 72 to allow for adjustment for the differences in slope of the portions of the embankment to which the stairways are staked. In a typical embankment work site, stairway sections of various lengths are individually staked to the embankment without interconnection with one another.

The frame 1, the hand rail assembly 23 and steps 21 are all preferably made from an aluminum alloy to provide a light weight and a durable construction. This allows ease in assembly and movement of the stairways.

Practical Application of the Invention

This invention provides a portable embankment stairway with steps that can quickly be adjusted on location to provide level step treads for the part of the embankment on which the stairway is temporarily staked. Embankments at railway trestles, for instance, seldom have a uniform slope. A worker stairway can be temporarily formed by use of a plurality of stairways of different lengths with step angle of the various stairways adjusted according to the slope of the part of the embankment on which the particular stairway is staked. When work at the trestle is completed the embankment stairways are removed, folded to a stored configuration, and stored pending later use on other embankments. If a part of the embankment has a nearly level part, the steps of a section of the embankment stairway can be adjusted to provide a horizontal walkway when the stairway section is installed in that nearly level part. Thus, this embankment stairway affords a safe stairway, work platform and walkway by which workmen can safely and quickly perform work assignments with less physical effort.

What is claimed is:

1. A portable embankment stairway comprising:

a stairway frame including a first elongated siderail having two ends;

a second elongated side rail parallel to said first side rail and having two ends, and a plurality of parallel channel members of U-shaped section having webs rigidly secured to the underside of said side rails in spaced relation to one another and in transverse relation to said side rails, said channel members including flanges extending downwardly from opposite sides of said web, a plurality of transverse steps disposed between and pivotally connected on parallel transverse axes to said first and second side rails, said steps being spaced from one another in the direction of elongation of said side rails, and each of said steps having a flat tread, a tie bar pivotally connected to said steps such that the pivoting of any of said steps relative to said side rails will equally pivot each of the other of said steps and a releasable locking mechanism with engageable parts on one of said steps and at least one of said rails, said locking mechanism being operable to fix said one step in a plurality of pivoted positions relative to said side rails whereby said steps may be pivotally adjusted so that their treads are horizontal when said stairway is installed at selected angles between 0 and 60 degrees to horizontal, said locking mechanism including transverse openings in one of said side rails, which openings are circumferentially spaced from one another in an arc whose center is coaxial with the axis about which said one step pivots relative to said one side rail and a transversely extensible and retractable pin mounted on said one step for selective locking engagement with and disengagement from said transverse openings, wherein said channel members include tab portions extending laterally beyond said side rails, said tab portions including openings for receiving stakes for securing said embankment stairway to an earthen embankment.

2. The embankment stairway as set forth in claim 1 wherein said locking mechanism includes transverse openings in both of said side rail components and a pair of extensible and retractable pins mounted on said one step component which are engageable with said transverse openings.

3. The embankment stairway as set forth in claim 1 having handrail upright members rigidly connected, respectively, to a plurality of said steps.

4. The embankment stairway as set forth in claim 1 having diagonal cross braces rigidly secured to the underside of said sides rails and to said channel members.

* * * * *